US005370366A

United States Patent [19]

Ottemann

[11] Patent Number: 5,370,366

[45] Date of Patent: Dec. 6, 1994

[54] BACKWIND SAILBOAT WINCH

[75] Inventor: William C. Ottemann, Fallbrook, Calif.

[73] Assignee: Harken, Inc., Pewaukee, Wis.

[21] Appl. No.: 21,214

[22] Filed: Feb. 23, 1993

[51] Int. Cl.[5] ..... B66D 1/14; B66D 1/22

[52] U.S. Cl. ..... 254/343; 254/344; 475/7; 475/8

[58] Field of Search ..... 254/343, 344; 475/3, 475/4, 5, 7, 8, 12, 283

[56] References Cited

U.S. PATENT DOCUMENTS

| | | | |
|---|---|---|---|
| Re. 30,881 | 3/1982 | Huggett et al. | 254/354 X |
| 1,554,634 | 9/1925 | Kersting | 254/343 X |
| 2,406,156 | 8/1946 | Nardone | 475/4 X |
| 2,621,544 | 12/1952 | Rossmann | 475/4 |
| 3,554,053 | 1/1971 | Bugaenko et al. | 475/7 X |
| 3,973,755 | 8/1976 | Fawcett | 254/354 |
| 3,998,431 | 12/1976 | Fawcett | 254/343 |
| 4,261,549 | 4/1981 | Bonassi | 254/344 X |
| 4,994,001 | 2/1991 | Wilkinson et al. | 475/4 |

*Primary Examiner*—Daniel P. Stodola
*Assistant Examiner*—Michael R. Mansen
*Attorney, Agent, or Firm*—Juettner Pyle Lloyd & Piontek

[57] ABSTRACT

A backwind feature is provided on a line-receiving winch and is particularly suitable for use on high capacity sailboat winches. The winch includes a main drive train to drive the drum of the winch in a winding direction and to prevent rotation in the opposite direction. A planetary gear assembly is provided on the output shaft of the winch, which permits independent rotation of the drum by a separate worm drive, without the need to disconnect any portion of the main drive.

5 Claims, 4 Drawing Sheets

BACKWIND SAILBOAT WINCH

BACKGROUND OF THE INVENTION

This invention relates to winches and more particularly to geared sailboat winches having a feature to enable reverse action of the normal cranking movement under certain conditions.

Conventional sailboat winches, such as those described in U.S. Pat. No. 4,261,549 and references cited therein, incorporated herein by reference, comprise a rotary line receiving drum mounted on a fixed support base secured to the deck of a sailboat or other support structure. The drum is rotated in one direction by cranking a central shaft connected by gears to the drum A line, connected to a sail or other operative elements of a sailboat, is wrapped around the drum in frictional engagement therewith. A reduced gear ratio is typically provided between the central shaft and the drum to provide a mechanical advantage and reduce the effort required to crank in the line under tension.

As will be described in more detail herein in connection with FIG. 2, it is well known to provide a winch with more than one speed. Multiple speed winches have drums which are capable of rotation in only one direction, usually a clockwise direction. Rotation in a counterclockwise direction is prevented by a ratchet mechanism, which usually comprises spring loaded pawls engageable in detents in the gear drive, or some equivalent mechanism. An extra speed is attained by the use of an extra gear which becomes operable upon reversal of rotary motion of the main drive shaft. For example, a typical two speed winch will have a 1:1 ratio when the drive shaft is rotated in a clockwise direction and a lower drive ratio when the drive shaft is cranked or rotated in a counterclockwise direction, with the drum always moving in a clockwise direction. When trimming in a sheet for a sail, the line initially has low tension, and a high cranking ratio is desired. When the sail is almost completely trimmed, the tension on the sheet or line increases substantially, and a lower cranking ratio is desired. The cranking power to the input drive shaft of the winch may be provided by a manual crank or an electrical or hydraulic motor.

Sailboat winches are produced in a variety of sizes or drum diameters and a variety of speeds and gear ratios to accommodate sailboats of various sizes. As the sail area and weight of a yacht increases, the sheeting loads exerted on the winch increase very substantially. In fact, the load on the line at the winch of a large sailboat may be so high when the sail is fully trimmed that it may be dangerous for an individual to release or ease out the line by hand, and controlled release of the tension may be very difficult.

In view of the above considerations, it is desirable to provide a high load capacity winch with a so-called backwind feature. It is known to connect the drive of a winch to a worm gear which can be operated to rotate the winch drum in a counterclockwise direction or opposite to the winding direction and relieve the initial high pressure or tension on the line to a safe level. The worm gear remains locked during normal operation of the winch. Previous proposals for backwind winches, however, have required a mechanism to deactivate at least one set of the one-way ratchet mechanisms in the gear chain to allow reverse movement of the drum. These proposals have been very complicated and costly, and the winch is limited to one winding drive speed when the backwind mechanism is employed.

In view of the foregoing, it would be desirable to provide a sailboat winch with a backwind feature which may be operated independently of the one-way ratchet or pawl mechanisms commonly employed in winches of this nature, while leaving the main drive train fully connected and operational.

SUMMARY OF THE INVENTION

A conventional sailboat winch, preferably a multi-speed winch, is provided with an independent backwind feature which does not require interaction or interference with the primary drive mechanism and associated ratchets. A worm gear is connected to an independent planetary gear having an output connected to the output drive shaft of the winch. The worm gear can be rotated in either direction to rotate the drum of the winch in two directions independently of the main drive. During normal operation of the winch, operable portions of the planetary gearing are locked by the inherent function of the worm drive. Preferably a greater than a one to one ratio is provided between the output of the worm gear and the output of the planetary to reduce the load on the worm gear and associated drive means. Since the worm drive can operate independently, the main drive train of the winch remains fully connected and operational, and no disengagement of a ratchet or other locking mechanism is required.

THE DRAWINGS

DESCRIPTION OF THE PREFERRED EMBODIMENTS

Figure 1:
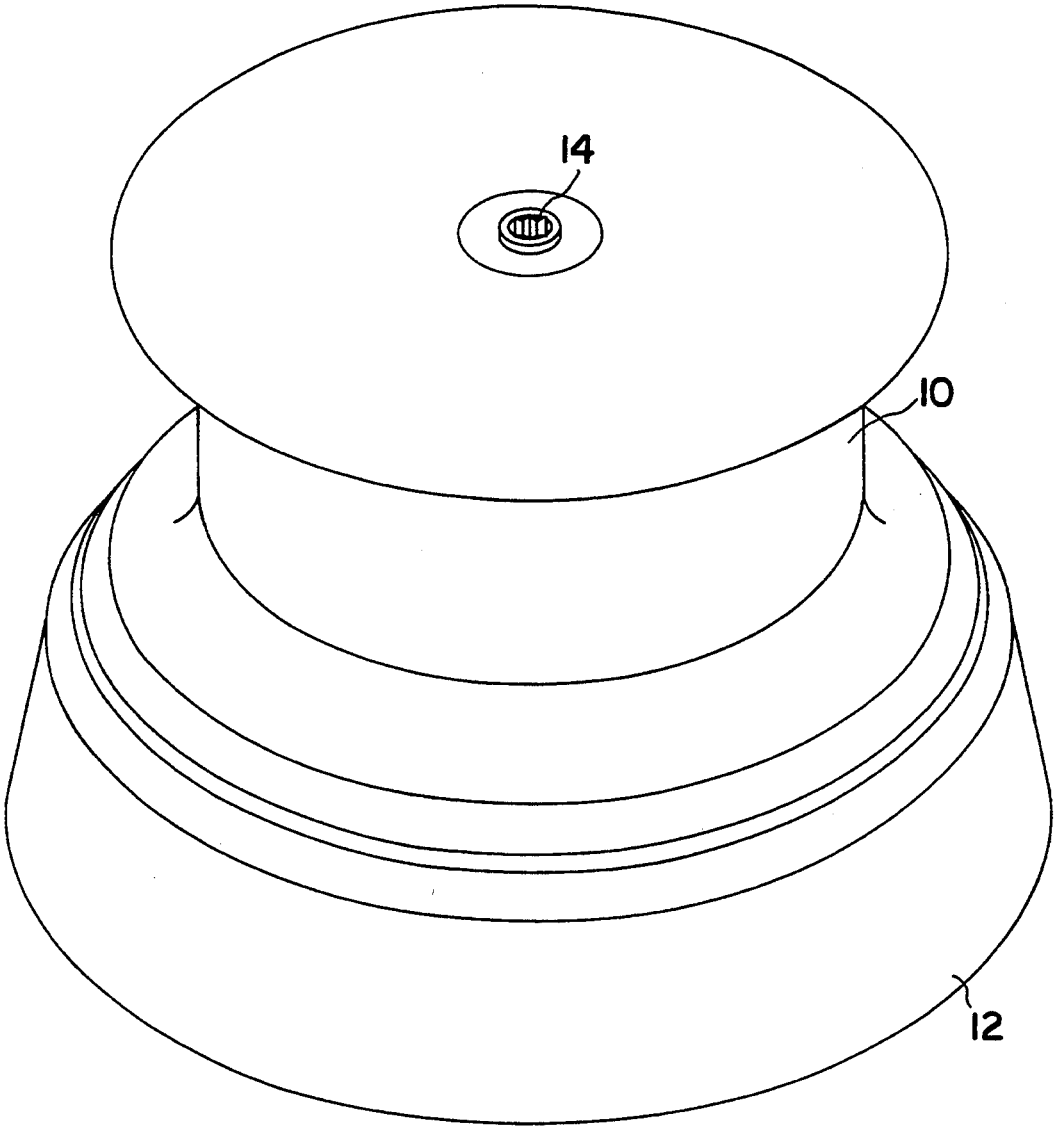
FIG. 1 is a perspective view of a conventional sailboat winch.
Figure 2:
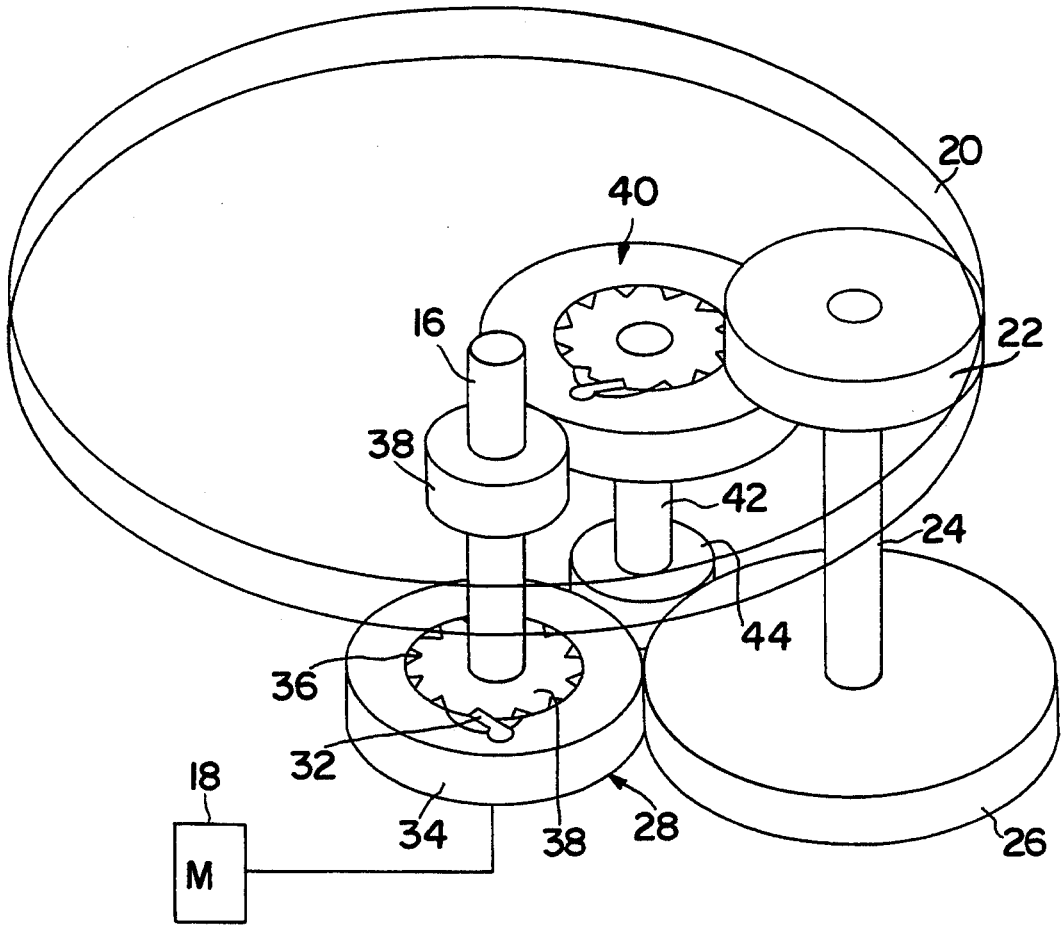
FIG. 2 PRIOR ART
FIG. 2 is a perspective schematic sailboat winch view of the gearing of a conventional two speed sailboat winch.

FIG. 1 is an overall view of a conventional winch, and FIG. 2 is a perspective schematic view of the drive train of a conventional two-speed winch. It will be appreciated that the details of construction of these winches are very well known to those skilled in the art and are described in numerous prior patents and in engineering and assembly drawings available from manufacturers. Except for the novel backwind feature of the present invention, these details have been omitted for the sake of clarity.

As shown in FIGS. 1 and 2, the conventional winch comprises a rotatable, line receiving drum 10 mounted on a fixed base 12, which is typically affixed to the deck of a sailboat or other suitable support structure. The winch may be operated manually by means of a crank (not shown) inserted into a top socket 14 connected to the main drive shaft 16, or may be operated by a hydraulic or electric motor, shown schematically at 18 (FIG. 2), connected to the bottom end of the main drive shaft. A line (not shown) is wrapped around the drum in the drum winding direction, and the drum is rotated in a clockwise direction to draw in the line.

FIG. 2 shows the essential features of a conventional two-speed winch. The drum 10 has a circular internal ring gear 20 which is meshed with a final drive gear 22 mounted on one or top end of an output shaft 24. A second, longer diameter gear 26 is mounted on the other or lower end of the output shaft 24. The gear 26 is driven either one ways by a drive gear 28 on the main drive shaft 16 or by a secondary drive train from the main drive shaft, depending on which of the two speeds is selected.

The lower end of the main drive shaft 16 is connected to the drive gear 28 having a ratchet mechanism which engages when the shaft 16 is rotated in a counterclockwise direction. The ratchet mechanism may comprise a plurality of spring loaded pawls 32 mounted in an outer ring 34 of drive gear 28 and engageable with detents 36 in the separate hub 38 of the gear secured to the shaft 16. When shaft 16 is rotated in a clockwise direction, the pawls 32 release and ride over the detents 36.

Drive gear 28 is meshed with the gear 26 on the output shaft. Rotation of the main shaft in a counterclockwise direction thus causes rotation of the output members 30, 24, and 22 and ring gear 20 of drum 10 in a clockwise direction.

The secondary drive chain comprises an upper drive gear 38 on the main shaft 16 in meshing engagement with a one-way ratchet gear 40 or a secondary shaft 42 mounted in a spaced parallel relation with the other shafts 16 and 24. A gear 44 is mounted on the lower end of secondary shaft 42 and is meshed with gear 26 in a spaced relation to gear 28.

Rotation of drive shaft in a clockwise direction causes driving engagement and rotation of gear 40, shaft 42 and gear 44 in the opposite direction, which, in turn, rotate gear 26, shaft 24 and gear in a clockwise direction. Under normal situations, the gear diameters are arranged such that a higher or first gear is available during clockwise rotation of drive shaft 16, and a lower gear is available upon counterclockwise rotation.

It will be noted, however, that the winch drum is capable of clockwise rotation either by operation of the drive shaft or by manual turning of the drum. The present invention comprises a feature to enable the drum and output shaft 24 to rotate in a controlled manner in a counterclockwise direction, or in a direction opposite to the winding direction. As may be seen, this is normally prevented by reason of the ratchet mechanisms in the gears. Also, it will be noted that when a drive has been selected by rotating the drive shaft in one direction, the pawls in the non-elected drive disengage.

Figure 3:
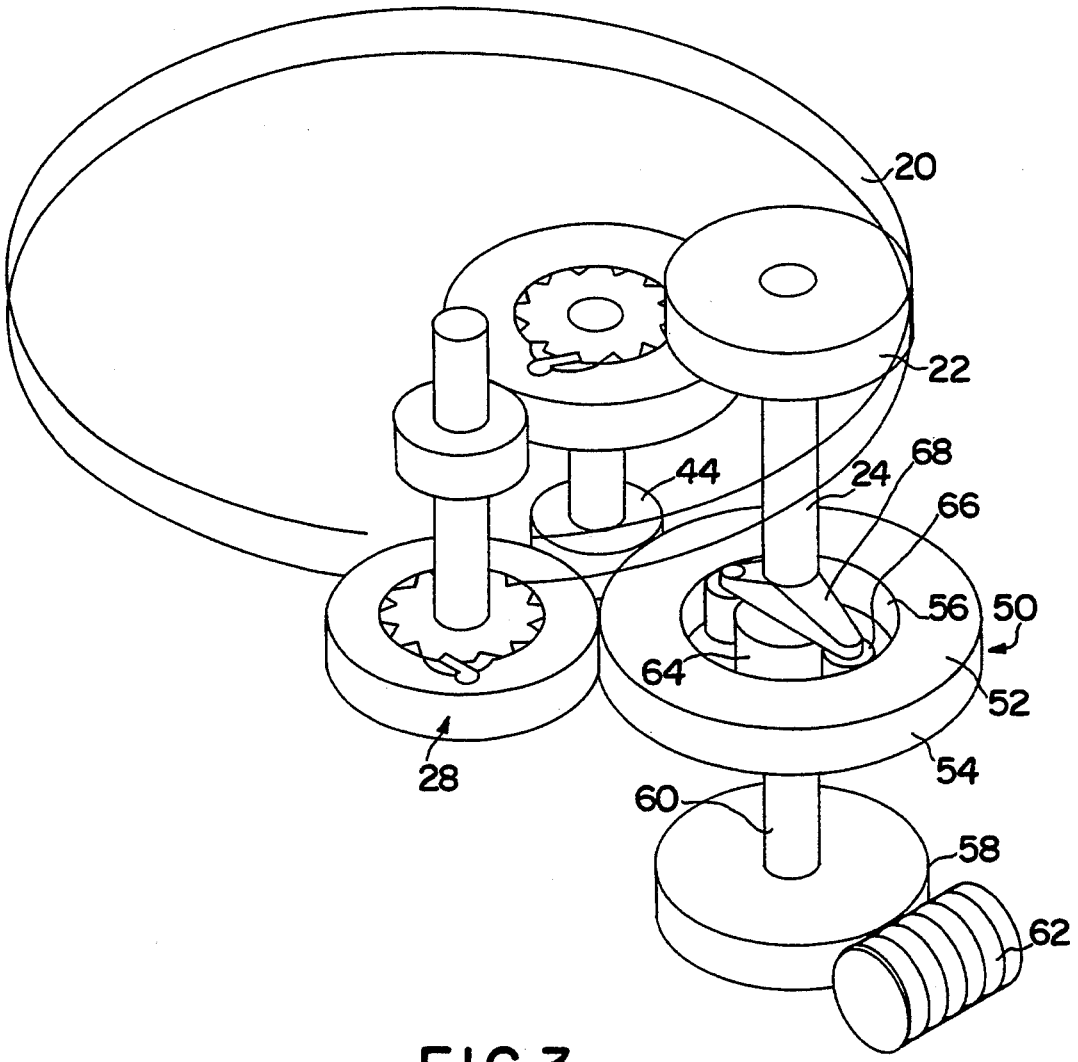
FIG. 3 is a perspective schematic view of the winch shown in FIG. 1, additionally showing the backwind feature of the present invention.
Figure 4:
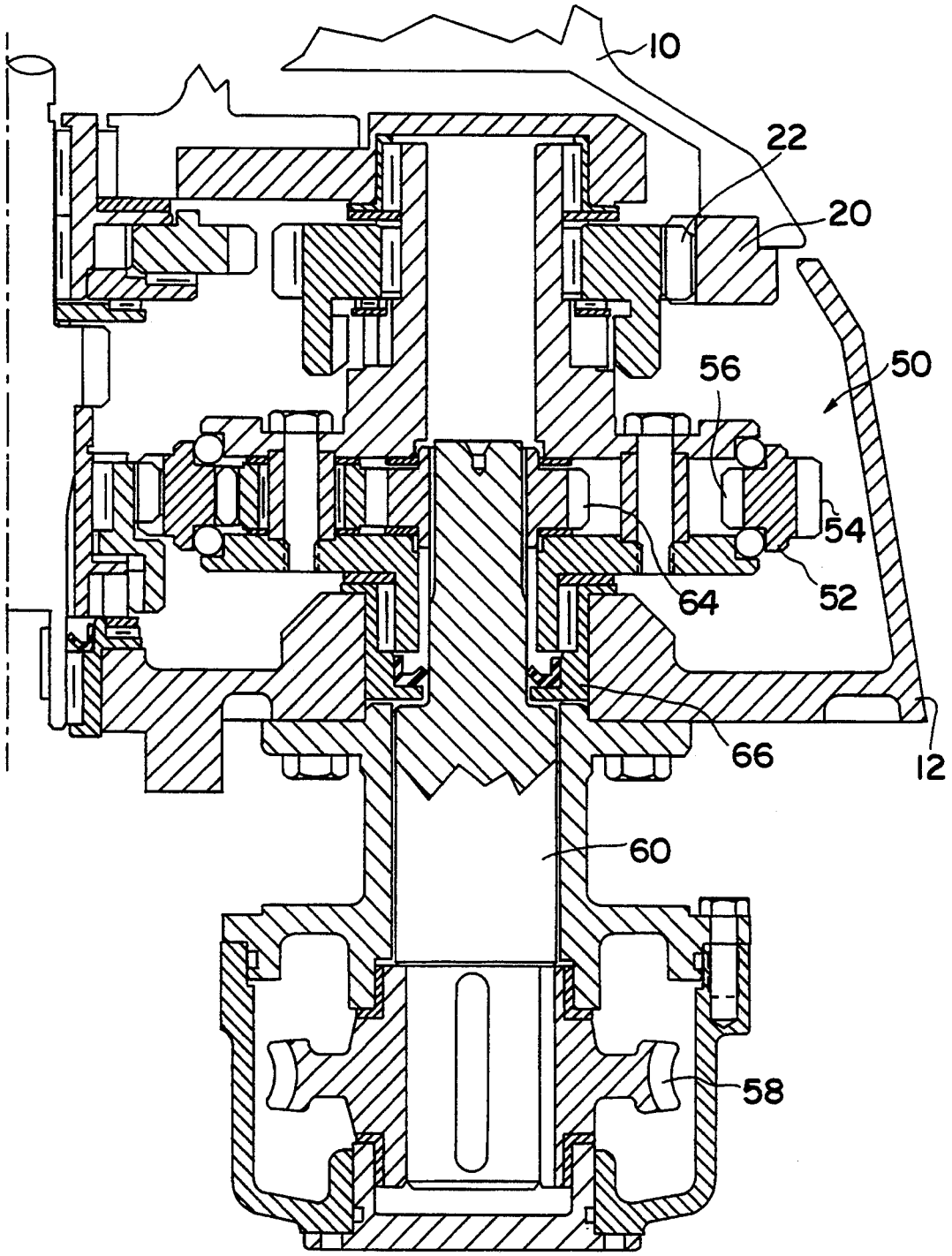
FIG. 4 is a detailed vertical sectional view of the backwind feature shown in FIG. 3.

FIGS. 3 and 4 show the backwind feature of the present winch in a connection with a multi-speed winch, such as the two-speed winch shown in FIG. 2. The normal output gear 26 is replaced by a planetary gear assembly, generally indicated at 50. The planetary gear has an outer ring gear 52 with an outer gear surface 54 meshed with the gears 28 and 44 of the two drives. The planetary ring gear 52 also has an inner gear surface 56.

An auxiliary drive gear 58 is secured to the end of a shaft 60 and is spaced beneath the planetary gear assembly. The gear 58 is in engagement with a coarsely threaded worm 62, which may be rotated by a drive means (not shown) in either direction.

A sun gear 64 is secured to the other end of the shaft 60 in the center of the planetary gear assembly 50. A plurality of planet gears 66 are meshed between the sun gear 64 and the inner gear surface 56 of the ring. The shafts of the planetary gears 66 are secured by a suitable common link or pedestal 68 to the output shaft 24 for the winch.

The use of the planetary gear allows for independent rotation of the output shaft and the winch drum in either direction without movement of any of the primary drive components of the winch. If, for example, the gear 58 is rotated in a counterclockwise direction by the worm 62 the shaft 60, sun gear 64, planetary gears 66 and output shaft 24 rotate in the same direction without causing any rotation of the outer ring 52, which, in any event, could not occur because of the locked pawls in the drive train. In normal operation, rotation of the outer ring 52 by either of the gears 28 or 44 causes corresponding rotation of the planetaries 66 and output shaft 24 without causing rotation of the sun gear 64, which, in any event, is locked by the worm drive. The gear ratio from the gear 58 to the output is preferably on the order of three to one, which reduces the effort on the worm gearing. Also, especially in larger winches, there is a gear reduction of about 1.5:1 between the gear 52 and the output shaft 24, which increases the overall gear ratio of the winch.

In normal operation, a line will be wrapped around the winch drum, and the drum will be driven in a clockwise direction in a normal manner. When the winch is very highly loaded it may be very difficult and even dangerous to release the line in a normal or gradual manner. For example, the sheet of a large genoa sail is wrapped several turns around the drum and needs to be eased out a few inches for sail trimming or completely released for tacking. Since the winch drum is normally locked in a counterclockwise direction, the sheet would normally have to be released by allowing it to slip around the drum.

In accordance with the present invention, it is only necessary to activate the auxiliary worm drive to cause counterclockwise rotation of the winch drum to any desired extent. Thus, tension on the sheet may be relieved with the sheet fully wrapped on the drum without the possibility of uncontrolled slippage of the line on the drum. Although primarily intended for use as a backwind mechanism, the worm drive can also be operated to rotate the drum on the winding direction.

It will be noted that the worm drive is fully independent of the main drive train for the winch. Thus, it is not necessary to disconnect or deactivate any portion of the main drive, and the main drive remains fully connected and operable at all time.

I claim:

1. In a winch comprising a line receiving drum mounted for rotation on a fixed base, a main drive shaft in said winch, first drive means for driving said main drive shaft, an output shaft in driving relation with said drum, first gear means between said main drive shaft and said output shaft for causing rotation of said drum in a first direction upon operation of said first drive means, and ratchet means associated with said first gear means to prevent rotation of said first gear means in a direction opposite to the first direction, the improvement comprising a planetary gear assembly between said first gear means and said output shaft, said assembly comprising a ring gear in driving relation with said first gear means, a sun gear, a ring gear spaced around the sun gear, a plurality of planetary gears in driving relation between said sun gear and said ring gear, said planetary gears being rotatably mounted on shafts, means for connecting said shafts to said output shaft, and second drive means connected to said sun gear for rotation of said drum in a direction opposite to said first direction.

2. The improvement of claim 1 wherein a mechanical advantage is provided between said worm drive and said output shaft means.

3. The improvement of claim 1 wherein said first gear means comprises first and second gear trains providing two different gear ratios to said output shaft means.

4. The improvement of claim 1 wherein said second drive means comprises a worm gear engaged with said sun gear.

5. A backwind winch comprising a line receiving drum mounted for rotation on a fixed base, first drive train means in said winch for rotating said drum in a first winding direction, ratchet means in said first drive train means for preventing rotation of the first drive train in a direction opposite to the first winding direction, a planetary gear means operatively engaged between said first drive train means and said drum for permitting rotation of said drum gear in both directions, and second drive means operatively connected to said planetary gear means for rotation of said drum in said opposite direction.

* * * * *